United States Patent [19]

Hillinger

[11] Patent Number: 4,951,533

[45] Date of Patent: Aug. 28, 1990

[54] SCREWDRIVER WITH ENHANCED GRIP HANDLE

[75] Inventor: George Hillinger, Los Angeles, Calif.

[73] Assignee: Alltrade, Inc., Commerce, Calif.

[21] Appl. No.: 438,182

[22] Filed: Nov. 20, 1989

[51] Int. Cl.[5] ..... B25B 23/16

[52] U.S. Cl. ..... 81/177.1; 81/436; D8/83

[58] Field of Search ..... 81/177.1, 489, 900, 81/436; 16/DIG. 12, DIG. 19, 110 R; D8/82-84, 300, 303, DIG. 5-8, 322, 107

[56] References Cited

U.S. PATENT DOCUMENTS

| | | | |
|---|---|---|---|
| D. 273,268 | 4/1984 | Smith | 16/111 R X |
| D. 275,932 | 10/1984 | Himbert et al. | D8/83 |
| 2,466,502 | 4/1949 | Stiller | 16/DIG. 40 X |
| 3,848,871 | 11/1974 | Sweet et al. | 16/DIG. 12 X |
| 4,416,166 | 11/1983 | Jannard et al. | D8/303 X |

*Primary Examiner*—D. S. Meislin

*Attorney, Agent, or Firm*—Edgar W. Averill, Jr.

[57] ABSTRACT

An improved screwdriver having an enhanced gripping handle. The gripping handle has many suction cups on the surface. Preferably, the suction cups are supported on a cross-shaped base and have a cross-shaped recess at the bottom of the suction cup.

11 Claims, 2 Drawing Sheets

12
10
18
15
27
14
27
11
18
16
13

12

17
10
18
16
11
27
14
4
4
15
27
18
3
13
3

18
13
10
16
14
15
15
16
18

27
16
15
10
15
16
14
13
16
16
27
15
15
16
16
15
27
15
16
11
12
16

SCREWDRIVER WITH ENHANCED GRIP HANDLE

BACKGROUND OF THE INVENTION

The field of the invention is hand tools, and the invention relates more particularly to hand tools which require a combination of pushing forward and twisting.

The typical plastic handled screwdriver can be difficult to turn when attempting to loosen a corroded or otherwise tightly held screw. Also, many applications require the combined use of pressure and torque as in seating a large wood screw. Various attempts have been made to facilitate this task, and screwdrivers with generally spherical handles have found considerable acceptance. Another improved handle is shown in U.S. Pat. No. Des. 273,268 which utilizes many outwardly extending fins. A knurled design is shown in U.S. Pat. No. Des. 275,932. Handle grips with various exterior designs are shown in U.S. Pat. No. 4,416,166, and a handle with suction cups is shown on the tennis racket in U.S. Pat. No. 3,848,871. A well-known design of soap holder is shown in U.S. Pat. No. 2,466,502 utilizing a plurality of suction cups.

SUMMARY OF THE INVENTION

It is an object of the present invention to provide a screwdriver which is not only comfortable to grip, but also utilizes suction to provide an enhanced gripping action.

The present invention is for an improved screwdriver of the type having a handle and an elongated blade extending outwardly from the handle. The improvement comprises an enhanced gripping handle comprising an elastomeric collar adhered to the outer surface of the handle. The elastomeric collar includes a plurality of suction cups, each of the suction cups having a generally cross-shaped base. The cross-shaped base is oriented at an angle of about 45° with respect to the longitudinal axis of the handle. The suction cups may be combined with outwardly extending ribs and rods to improve user comfort. To further enhance the gripping action, a cross-shaped recess is formed at the base of each suction cup.

DESCRIPTION OF THE PREFERRED EMBODIMENTS

Figure 1:
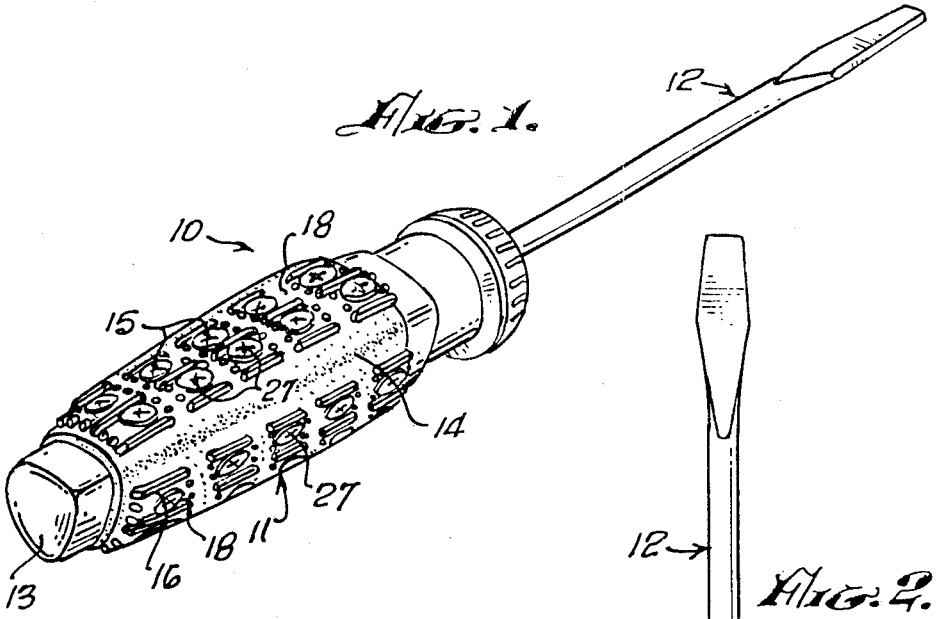
FIG. 1 is a perspective view of the improved screwdriver of the present invention.
Figure 4:
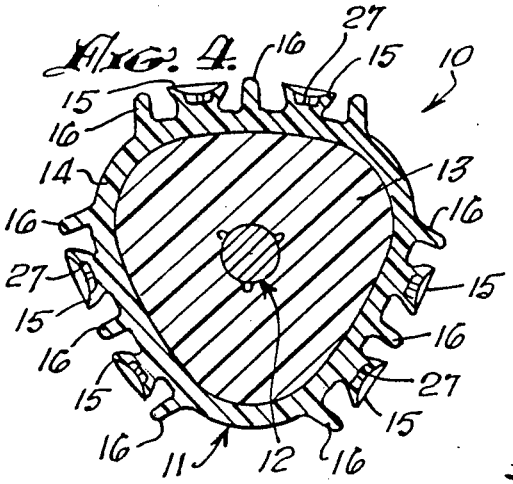
FIG. 4 is a cross-sectional view taken along line 4—4 of FIG. 2.

The improved screwdriver of the present invention is shown in FIG. 1 and indicated generally by reference character 10. Screwdriver 10 has a handle 11 and a blade portion 12. Handle 11 which is made from a polymer of high impact strength such as polyurethane is shown in cross-sectional view in FIG. 4 and is indicated by reference character 13. This inner portion 13 is covered with a grip enhancing elastomeric collar generally indicated by reference character 14.

Elastomeric collar 14 has a plurality of relatively large suction cups 15 and a plurality of longitudinally directed ribs 16.

Figure 2:
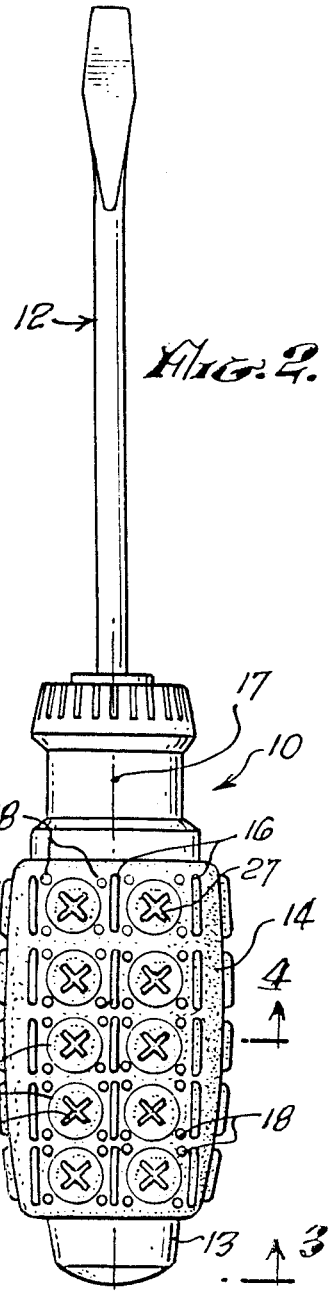
FIG. 2 is a side elevation thereof.
Figure 3:
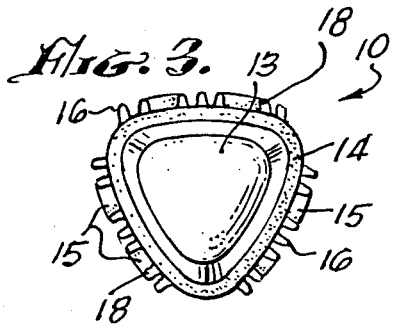
FIG. 3 is a view taken along line 3—3 of FIG. 2.

As seen best in FIG. 2, such suction cups 15 are oriented parallel with respect to the longitudinal axis 17 of the screwdriver. The suction cups are also oriented circumferentially around the handle 11 with the longitudinal ribs positioned between adjacent suction cups and on the outside of adjacent suction cups. A plurality of elastomeric rods 18 are also formed in elastomeric collar 14 and improve user comfort by helping to prevent any sort of pinching between suction cups.

Figure 5:
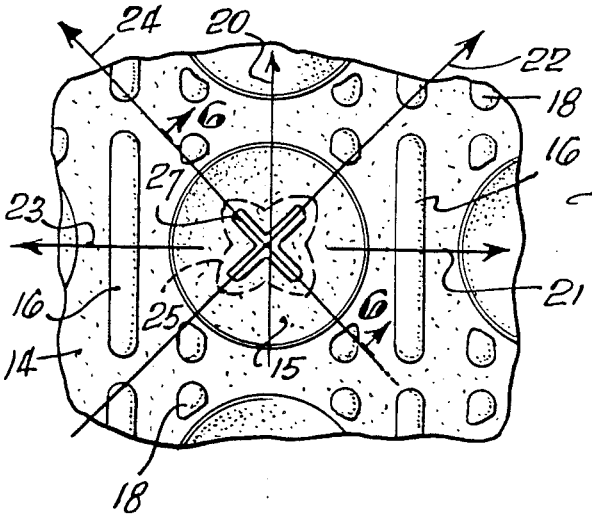
FIG. 5 is an enlarged plan view of one of the suction cups of the handle of the screwdriver of FIG. 1.
Figure 6:
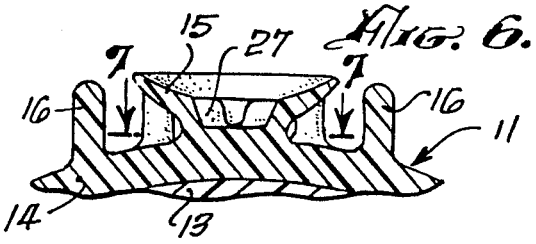
FIG. 6 is a cross-sectional view taken along line 6—6 of FIG. 5.
Figure 7:
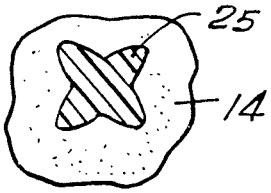
FIG. 7 is a cross-sectional view taken along line 7—7 of FIG. 6.
Figure 8:
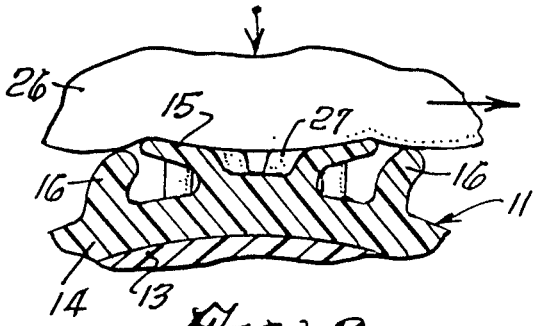
FIG. 8 is a cross-sectional side view showing one of the suction cups and two ribs being deformed by a user's palm.

The particular design of the suction cups of the grip of the present invention resulted from a careful study of the forces exerted by the user of the screwdriver. These forces are indicated in FIG. 5 with a forward force being indicated by reference character 20 and a twisting force indicated by reference character 21. The vector of these two forces is approximately at a 45° angle and is indicated by the arrow 22. It is, of course, necessary not only to turn a screwdriver but also to press it in so that it does not strip the slot of the screw. In a frozen screw, both the forward force and the turning force are both substantial, and the suction cups of the present invention are designed to provide maximum force at a 45° angle to coincide with this force vector. It should be noted that the loosening of a frozen screw provides a twist force in the opposite direction of 21 which is indicated by reference character 23. This results in a 45° angle force vector 24. As can also be seen in FIG. 5, the suction cup 15 is supported on a generally cross-shaped base 25 which increases the resistance to movement of the suction cup along vectors 22 and 24. The pressure of a palm on the suction cup is indicated in FIG. 8 where it can be seen that the palm depresses the suction cup thereby creating a vacuum which further assists in maintaining the grip between the user's palm 26 and the elastomeric collar 14.

Another grip enhancing feature is included in the center of each large suction cup 15. This comprises a generally cross-shaped recess 27 which provides a second suction cup at the base of each large suction cup. This suction cup is also oriented at a 45° angle to enhance the gripping action along vectors 22 and 24.

The screwdriver of the present invention thus provides suction power to enhance the conventional gripping power. The generally rounded triangular shape of the handle further enhances gripability and the result is a handle which is believed to have superior grip with the user's palm. The 45° angled cross support for each suction cup further enhances their resistance to deformation in the critical direction of the force vectors.

The elastomeric material used with the screwdriver of the present invention was fabricated from a polyvinylchloride polymer having a hardness such that it is readily deflected when squeezed. It was adhered to the polyurethane portion of the handle with an adhesive. The resulting handle is very comfortable to use and yet is capable of applying surprising force against the frozen or difficult to tighten or loosen screw.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. An improved screwdriver with a longitudinal axis, said screwdriver being of the type having a handle and an elongated blade extending outwardly from the handle, wherein the improvement comprises:

an enhanced gripping handle comprising an elastomeric collar having an inner surface adhered to the outer surface of the handle and said collar having a base portion having an outer surface, said elastomeric collar including a plurality of first suction cups, each of said first suction cups having upper edges and being supported by said base portion above the outer surface thereof by a generally cross-shaped base, said cross-shaped base having arms being oriented at about a 45° angle with respect to the longitudinal axis of said screwdriver.

2. The improved screwdriver of claim 1 wherein said first suction cups have a generally circular outer periphery.

3. The improved screwdriver of claim 2 wherein said first suction cups further include a second suction cup at the base of each first suction cup, said second suction cup comprising a generally cross-shaped recess in the base of each first suction cup, said cross-shaped recess being within the area of said cross-shaped base when viewed from above a first suction cup.

4. The improved screwdriver of claim 1 wherein said elastomeric collar further includes a plurality of longitudinally extending ridges between adjacent first suction cups, and wherein said ridges extend outwardly from said collar about the same distance as the upper edges of said first suction cups.

5. The improved screwdriver of claim 4 further including a plurality of raised rods extending outwardly from the base portion of the elastomeric collar at the corners of each of said first suction cups to a height about equal to the upper edges of said first suction cups.

6. The improved screwdriver of claim 1 wherein the outer surface of said handle is in the shape of a rounded triangle.

7. An improved screwdriver with a longitudinal axis, said screwdriver being of the type having a handle including a gripping area and a blade extending in a longitudinal direction with respect to said handle, wherein the improvement comprises:

an elastomeric sheet adhered to the gripping area of said handle, said elastomeric sheet including a plurality of suction cups extending outwardly therefrom and a plurality of ridges extending in said longitudinal direction between adjacent suction cups, said longitudinal ridges extending outwardly from said handle about the same distance as said suction cups extend.

8. The improved screwdriver of claim 7 wherein said suction cups are arranged circumferentially around said screwdriver handle.

9. The improved screwdriver of claim 8 further including four elastomeric rods extending outwardly from said handle about the same distance as the suction cups and the longitudinal ridges extend.

10. The improved screwdriver of claim 7 wherein each suction cup has a cross-shaped depression centrally located in the base thereof, said cross-shaped depression comprising two straight depressions, each of said straight depressions being oriented at a 45° angle with respect to the longitudinal axis of said screwdriver.

11. The improved screwdriver of claim 7 wherein a cross-section of said handle is in the shape of a rounded triangle.

* * * * *